US011091987B1

(12) United States Patent
Benker et al.

(10) Patent No.: US 11,091,987 B1
(45) Date of Patent: Aug. 17, 2021

(54) PERFORATION GUN SYSTEM

(71) Applicants: CYPRESS HOLDINGS LTD., Austin, TX (US); AXIS WIRELINE TECHNOLOGIES, LLC, Venetia, PA (US)

(72) Inventors: David Council Benker, Cedar Park, TX (US); Thomas James Lonsdale, II, Austin, TX (US); Charles Meredith, Austin, TX (US); Joseph Sites, Venetia, PA (US)

(73) Assignees: CYPRESS HOLDINGS LTD., Austin, TX (US); AXIS WIRELINE TECHNOLOGIES, LLC, Venetia, PA (US)

( * ) Notice: Subject to any disclaimer, the term of this patent is extended or adjusted under 35 U.S.C. 154(b) by 0 days.

(21) Appl. No.: 17/201,552

(22) Filed: Mar. 15, 2021

Related U.S. Application Data

(60) Provisional application No. 62/989,279, filed on Mar. 13, 2020.

(51) Int. Cl.

| | |
|---|---|
| ***E21B 43/117*** | (2006.01) |
| ***E21B 43/116*** | (2006.01) |
| ***F42D 1/055*** | (2006.01) |
| ***E21B 43/1185*** | (2006.01) |

(52) U.S. Cl.
CPC ..... *E21B 43/1185* (2013.01); *E21B 43/116* (2013.01); *F42D 1/055* (2013.01)

(58) Field of Classification Search
CPC .. E21B 43/1185; E21B 43/117; E21B 43/119; E21B 43/116; E21B 43/11857; F42D 1/055; F42D 1/043; F42D 1/045; F42D 1/05; F42B 3/121
See application file for complete search history.

(56) References Cited

U.S. PATENT DOCUMENTS

| | | | |
|---|---|---|---|
| 2,759,417 | A | 8/1956 | O'Neill, Jr. |
| 2,833,213 | A | 5/1958 | Udry |
| 4,208,966 | A | 6/1980 | Hart |
| 4,441,427 | A | 4/1984 | Barrett |
| 4,869,170 | A | 9/1989 | Dahmberg et al. |
| 5,088,413 | A | 2/1992 | Huber et al. |
| 5,347,929 | A | 9/1994 | Lerche et al. |
| 5,435,250 | A | 7/1995 | Pollock |
| 6,658,981 | B2 | 12/2003 | Rochen et al. |
| 6,837,310 | B2 | 1/2005 | Martin |
| 7,762,331 | B2 | 7/2010 | Goodman et al. |

(Continued)

FOREIGN PATENT DOCUMENTS

| | | |
|---|---|---|
| EP | 0874130 B1 | 1/2006 |

OTHER PUBLICATIONS

"Multi-material injection molding," retrieved from https://en.wikipedia.org/w/index.php?title=Multi-material_injection_molding&oldid=994490766, last edited Dec. 16, 2020, 3 pages.

(Continued)

*Primary Examiner* — Daniel P Stephenson
(74) *Attorney, Agent, or Firm* — Trop, Pruner & Hu, P.C.

(57) ABSTRACT

A perforation gun that includes a monolithic bulkhead electrical contact that includes no resilient members but that is resiliently coupled to two perforating guns. The bulkhead electrical contact is configured to transmit a signal across a bulkhead from one gun to another gun.

20 Claims, 16 Drawing Sheets

(56) References Cited

U.S. PATENT DOCUMENTS

| | | | | |
|---|---|---|---|---|
| 8,091,477 | B2 | 1/2012 | Brooks et al. | |
| 8,256,337 | B2 | 9/2012 | Hill et al. | |
| 8,661,978 | B2 | 3/2014 | Backhus et al. | |
| 8,746,144 | B2 | 6/2014 | Givens et al. | |
| 8,770,301 | B2 | 7/2014 | Bell | |
| 8,875,787 | B2 | 11/2014 | Tassaroli | |
| 8,881,816 | B2 | 11/2014 | Glenn et al. | |
| 9,145,764 | B2 | 9/2015 | Burton et al. | |
| 9,605,937 | B2 | 3/2017 | Eitschberger et al. | |
| 9,689,223 | B2 | 6/2017 | Schacherer et al. | |
| 10,077,641 | B2 | 9/2018 | Rogman et al. | |
| 2016/0356132 | A1* | 12/2016 | Burmeister | E21B 43/119 |
| 2017/0275976 | A1 | 9/2017 | Collins et al. | |
| 2018/0299239 | A1* | 10/2018 | Eitschberger | H05K 5/0034 |
| 2019/0257181 | A1* | 8/2019 | Langford | E21B 43/119 |
| 2020/0256166 | A1* | 8/2020 | Knight | E21B 43/1185 |
| 2020/0300593 | A1* | 9/2020 | Sullivan | F42D 1/05 |
| 2020/0308939 | A1* | 10/2020 | Sullivan | E21B 43/117 |
| 2021/0055092 | A1* | 2/2021 | Sullivan | F42D 1/02 |
| 2021/0156231 | A1* | 5/2021 | Sullivan | E21B 43/1185 |

OTHER PUBLICATIONS

"Tandem Sub", retrieved from https://www.yjoiltools.com/Wireline-Subs/Tandem-Sub, 3 pages.

Zhao et al., "Sliding sleeve packer multistage completion in Re-exploration Programs for Petroleum-Rich Sags in Rift Basins, Advances in Key Engineering Technologies for Re-exploration 2018," https://www.sciencedirect.com/topics/engineering/completion-process.

Snyder, "Is the Shale Revolution Here to Stay," OilPrice.com—blog; https://community.oilprice.com/topic/6261-is-the-shale-revolution-here-to-stay/, May 15, 2019, 63 pages.

* cited by examiner

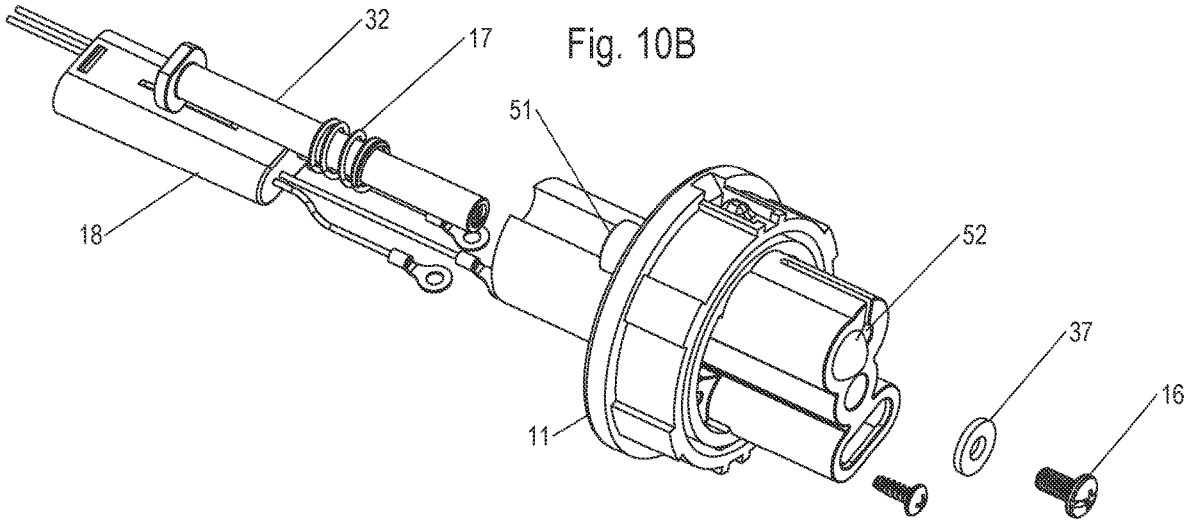
Fig. 10B
Fig. 10A
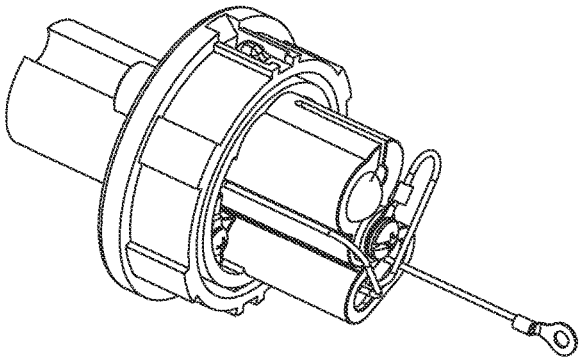

PERFORATION GUN SYSTEM

PRIORITY CLAIM

This application claims priority to U.S. Provisional Patent Application No. 62/989,279 filed on Mar. 13, 2020 and entitled "PERFORATION GUN SYSTEM". The content of the above application is hereby incorporated by reference.

TECHNICAL FIELD

Embodiments of the invention are in the field of oilfield equipment and, in particular, perforation guns.

BACKGROUND

In conventional methods a user may couple perforation guns together and then use explosives within the guns to fracture rock formations. Oil may then flow through the fractured rock formations. This may involve hydraulic "fracking", which involves injecting liquid at high pressure into subterranean rocks, boreholes, and the like to force open existing fissures and extract oil or gas. A typical perforation gun may include a long tube that includes charges. These guns may couple together with a coupler, which is sometimes called a "tandem sub" (https://***.yjoiltools.com/Wireline-Subs/Tandem-Sub). The coupler's external threads mate with internal threads of the gun.

BRIEF DESCRIPTION OF THE DRAWINGS

Features and advantages of embodiments of the present invention will become apparent from the appended claims, the following detailed description of one or more example embodiments, and the corresponding figures. Where considered appropriate, reference labels have been repeated among the figures to indicate corresponding or analogous elements.

FIGS. 10A and 10B provide perspective and assembly views for an embodiment a proximal connector.

DETAILED DESCRIPTION

Reference will now be made to the drawings wherein like structures may be provided with like suffix reference designations. In order to show the structures of various embodiments more clearly, the drawings included herein are diagrammatic representations of structures. Thus, the actual appearance of the fabricated structures, for example in a photograph, may appear different while still incorporating the claimed structures of the illustrated embodiments. Moreover, the drawings may only show the structures useful to understand the illustrated embodiments. Additional structures known in the art may not have been included to maintain the clarity of the drawings. "An embodiment", "various embodiments" and the like indicate embodiment(s) so described may include particular features, structures, or characteristics, but not every embodiment necessarily includes the particular features, structures, or characteristics. Some embodiments may have some, all, or none of the features described for other embodiments. "First", "second", "third" and the like describe a common object and indicate different instances of like objects are being referred to. Such adjectives do not imply objects so described must be in a given sequence, either temporally, spatially, in ranking, or in any other manner. "Connected" may indicate elements are in direct physical or electrical contact with each other and "coupled" may indicate elements co-operate or interact with each other, but they may or may not be in direct physical or electrical contact. Phrases such as "comprising at least one of A and B" include situations with A, B, or A and B.

Applicant determined conventional systems are cost-prohibitive, difficult to manufacture, and difficult to work with in the field. However, described herein are embodiments that address these concerns. Advantages of certain embodiments are, without limitation: (1) easier for field users to assemble since there are fewer threaded joints to assemble, (2) fewer threaded parts provide economic efficiencies (i.e., the coupler lacking threads saves costs normally used to impart threads on a tandem sub), and (3) the direct outer conduit to outer conduit connection provides a smaller chance of fluid getting leaking into a gun (in some embodiments there is a need for fewer O rings because there are fewer coupling surfaces). Other advantages are listed further below.

Figure 1A:
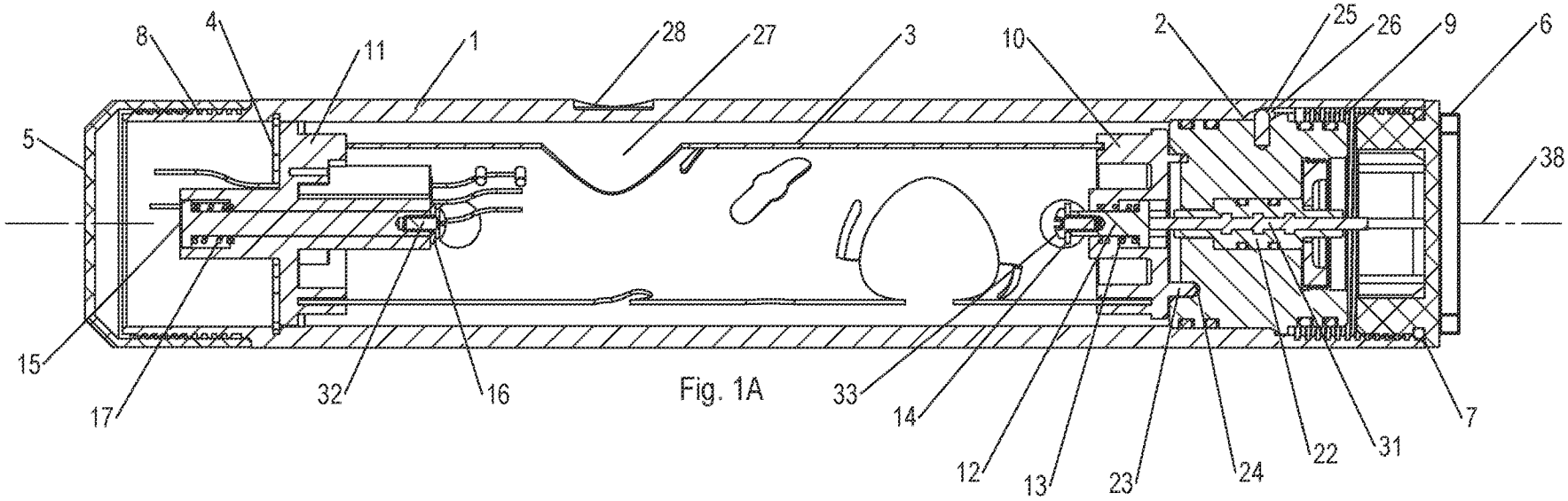
FIG. 1A includes a cross-sectional view of an embodiment of a single gun having inner and outer conduits, proximal and distal connectors (e.g., caps), and a coupler.

FIG. 1A illustrates a hydraulic fracturing system comprising a perforating gun. The gun includes an outer conduit 1, an inner conduit 3, a proximal cap 11 (a cap is a form of connector), a distal cap 10, a coupler 2 and a bulkhead 22. The inner conduit is included within the outer conduit. The outer conduit includes proximal and distal ends, the proximal end including outer threads 8 (male threads) and the distal end including inner threads 9 (female threads).

The distal cap includes a first distal electric contact 12 and a second distal electric contact 14. The first distal electric contact is resiliently coupled to a body of the distal cap via a distal resilient member 13. The second distal electric contact is resiliently coupled to the body of the distal cap via the distal resilient member. The first distal electric contact includes at least one metal, the at least one metal including at least one of stainless steel, bronze, brass, tin-plated metal, or combinations thereof.

The proximal cap includes a first proximal electric contact 15 and a second proximal electric contact 16. The first proximal electric contact is resiliently coupled to a body of the proximal cap via a second resilient member 17. The second proximal electric contact is resiliently coupled to the body of the proximal cap via the second resilient member. The first proximal electric contact includes at least one metal, the at least one metal including at least one of stainless steel, bronze, brass, tin-plated metal, or combinations thereof. The proximal cap includes an aperture 19 (FIG. 5C) and the aperture includes an electrical switch 18. The electrical switch couples at least one cable that is proximal to the proximal cap to at least one cable that is distal to the proximal cap. The proximal cap includes an additional aperture 20 and the additional aperture includes a detonator 21.

Figure 7:
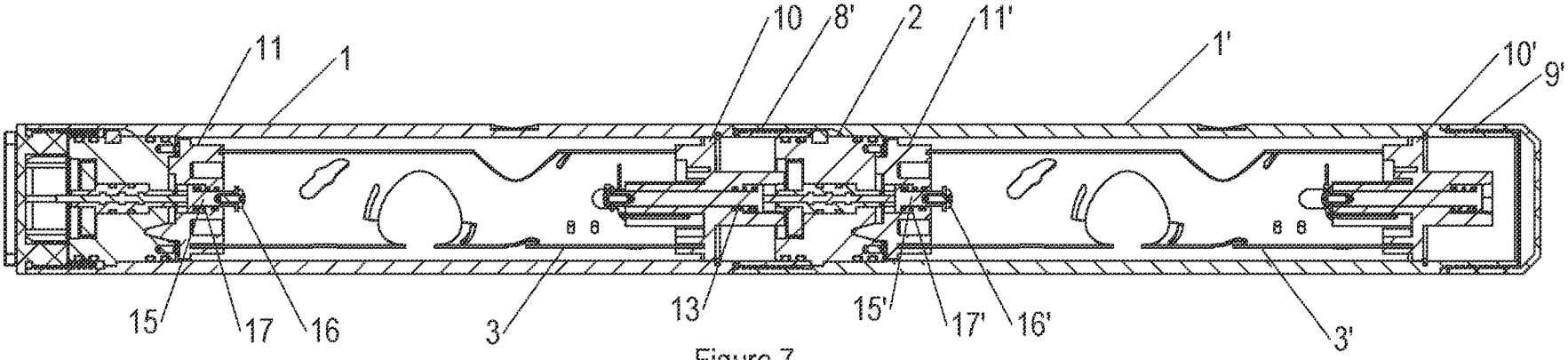
FIG. 7 includes an embodiment of a system having two gun assemblies.
Figure 8:
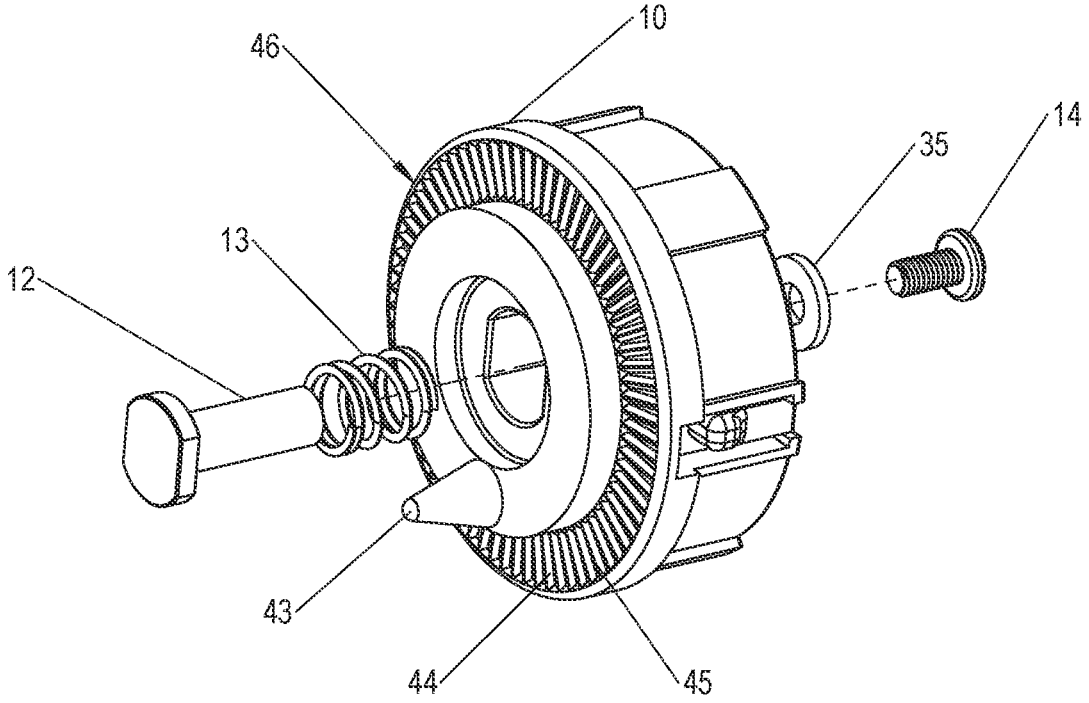
FIG. 8 includes a cross-sectional view of an embodiment of a distal connector.
Figure 9A:
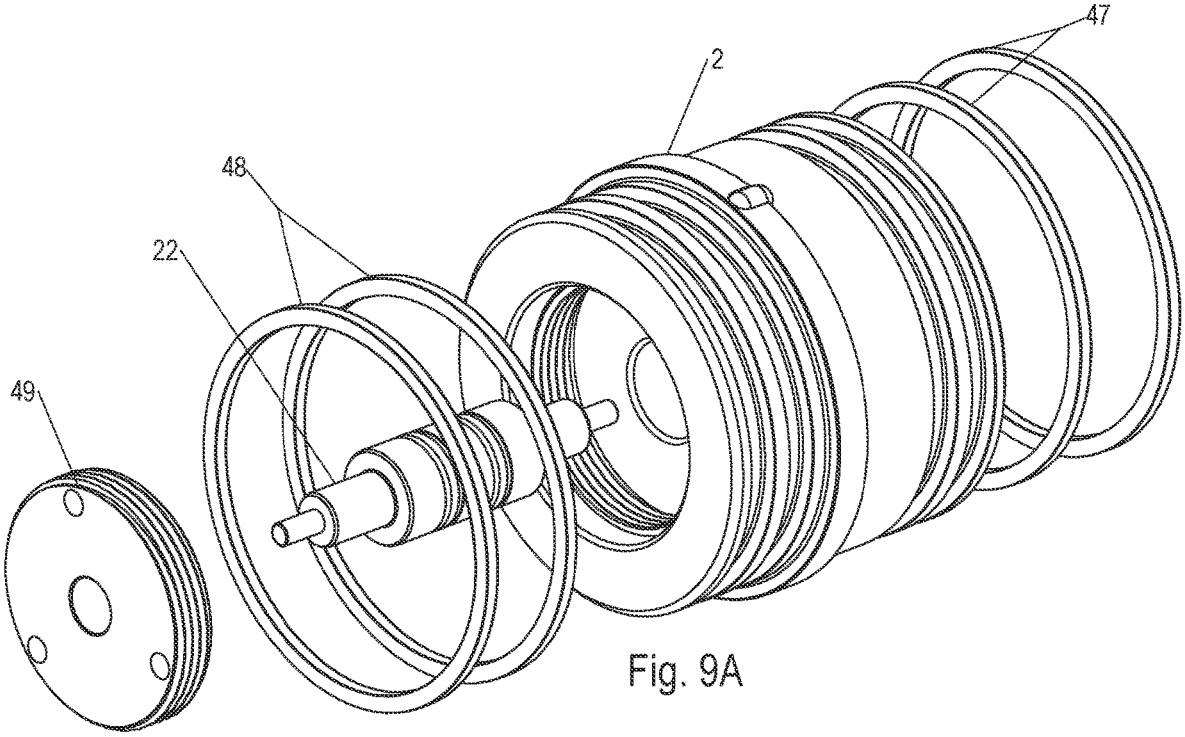
FIGS. 9A, 9B, 9C, 9D, 9E depict assembly, rear, front, perspective, and cross-sectional views of an embodiment of a coupler to mate with the distal connector of FIG. 8.
Figure 9B:
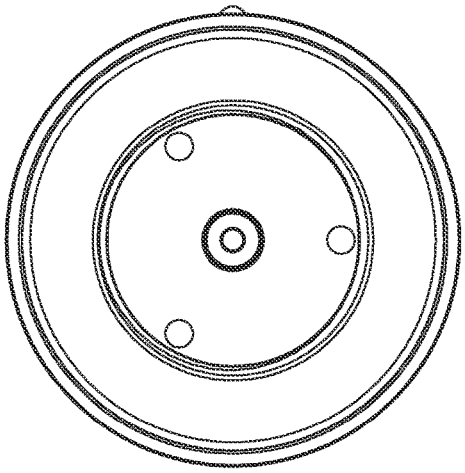
Figure 9C:
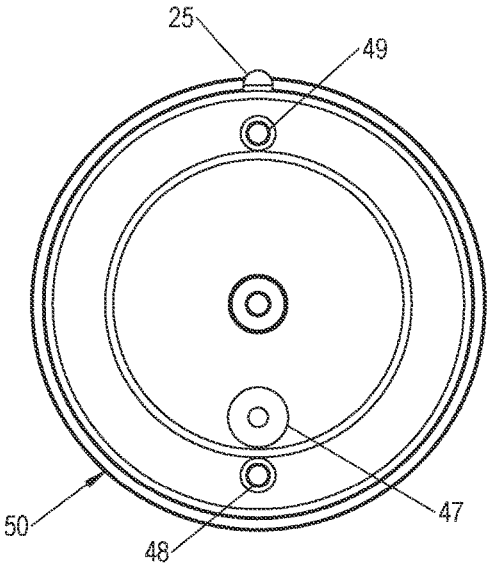
Figure 9E:
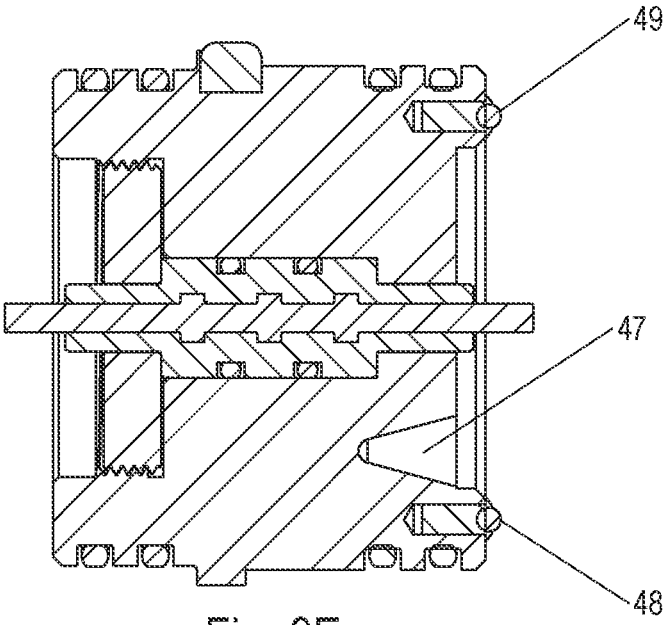
Figure 9D:
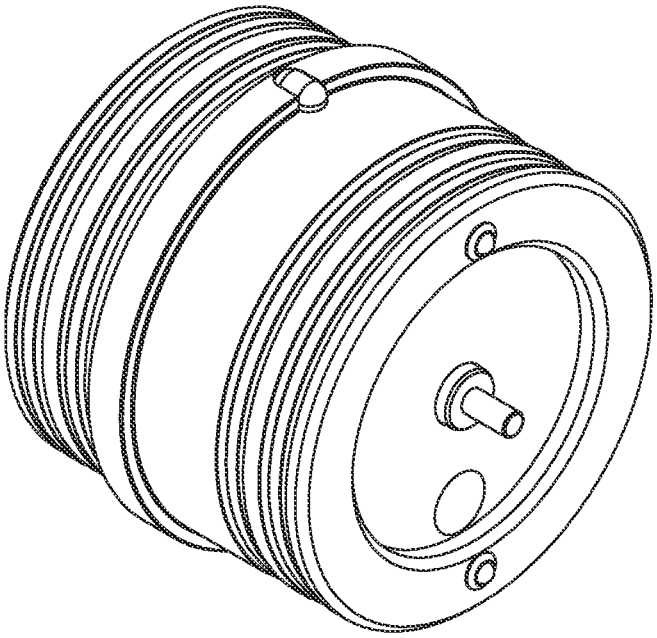

FIG. 7 shows an additional perforating gun, which includes an additional outer conduit 1', an additional inner conduit 3', an additional proximal cap 11', and an additional distal cap 10'. The additional proximal cap includes an additional first proximal electric contact 15' and an additional second proximal electric contact 16'. The additional first proximal electric contact is resiliently coupled to a body of the additional proximal cap via an additional second resilient member 17'. The additional second proximal electric contact is resiliently coupled to the body of the additional proximal cap via the additional second resilient member. The additional first proximal electric contact includes at least one metal, the at least one metal including at least one of stainless steel, bronze, brass, tin-plated metal, or combinations thereof;

Coupler 2 has no external threads (although all embodiments are not limited in this way). Bulkhead 22 is included within the coupler. The bulkhead includes no resilient members (not including items such as o-rings), such as coils or springs. The bulkhead directly contacts both the first distal electrical contact 12 and the additional first proximal electrical contact 15' of FIG. 7. The first resilient member 13 biases the first distal electrical contact towards the bulkhead in a first direction and the additional second resilient member 17' biases the additional first proximal electrical contact towards the bulkhead in a second direction that is opposite the first direction.

Contact 31 has no spring-induced physical bias and is configured to directly contact the first distal electrical contact 12 and another contact of another gun (e.g., contact 15 of another gun). First resilient member 13 is configured to bias the first distal electrical contact 12 towards contact 31.

Any of the contacts may be made of a material that is not easily magnetized or corroded, such as stainless steel. As a result, system reliability is enhanced considering the system may be exposed in the field to caustic and/or magnetic field environments. Embodiments may use stainless steel, brass, bronze, tin-based alloys, tin-plated metals, or combinations thereof.

In an embodiment, contact 15 has a non-circular cross-section. For example, see flat portions 29 and/or 30 of FIG. 5C. Such a keyed profile ensures the contact does not rotate within the cap when screw 32 is tightened, which consequently promotes a more reliable electrical path for data signals, and the like. Contact face 32 has a larger surface area than contact 31 of the bulkhead.

Figure 4B:
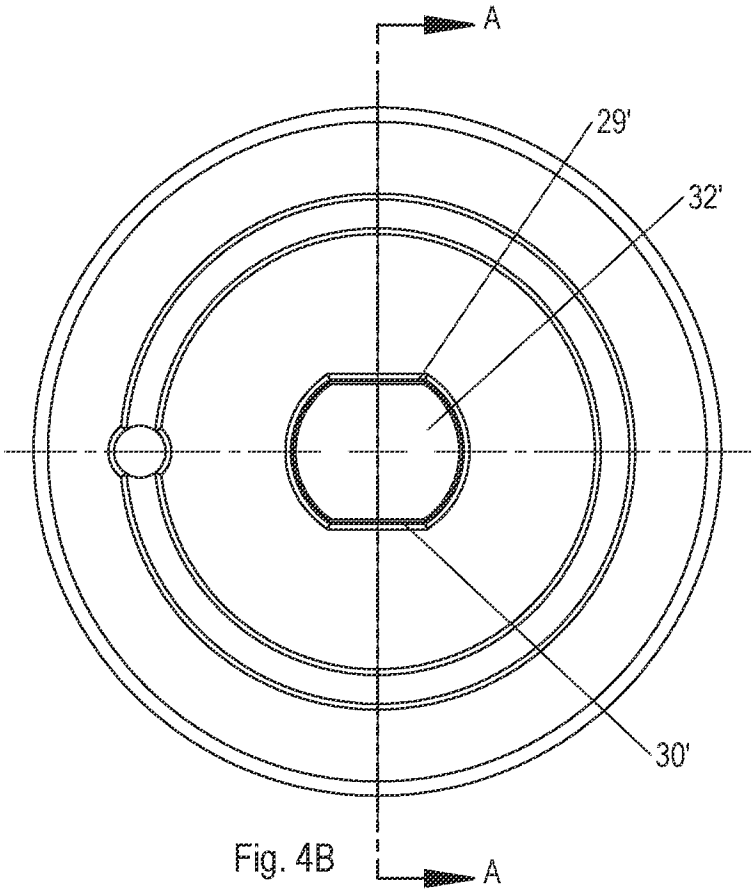
FIG. 4B includes a rear view of the same.

In an embodiment, contact 12 has a non-circular cross-section. For example, see flat portions 29' and/or 30' of FIG. 4B. Such a keyed profile ensures the contact does not rotate within the cap when screw 33 is tightened, which consequently promotes a more reliable electrical path for data signals, and the like. Contact face 32' has a larger surface area than contact 31 of the bulkhead.

Regarding the bulkhead of FIG. 1A, the bulkhead provides advantages over conventional systems that conduct data signals through resilient members, such as springs. With vibrating environments common to oilfields, this conduction path can be less than reliable. However, in the embodiment of FIGS. 1A and 7 contacts 12 and 15 (or the version of 15 on a neighboring gun, which is seen in FIG. 7) are biased towards contact 31. The path then conducts directly from contact 12, to contact 31, to contact 15 (or the version of 15 on a neighboring gun, which is seen in FIG. 7). This path has fewer physical interfaces than conventional systems (i.e., there is no interface between a pin contact and spring and a metal sealing surface and then to a spring and to another pin contact), which promotes reliability for conduction of signals. Contacts 12, 15 utilize springs 13, 17 to maintain continuity despite vibrations and the like that are inherent to operating conditions in the oilfield. Wires/cables are secured to contacts 12, 15 by wrapping around screws 32, 33 (referred to above as contacts 16, 14).

In an embodiment, coupler 2 is keyed to the distal cap 10. For example, in FIG. 1A projection 23 is keyed to void 24 to ensure the distal cap (and the rest of the inner tube) are oriented in only one way to the coupler. As a result, and for example, void 27 (which holds a charge as shown in FIG. 7) aligns with void 28, thereby aligning a charge with void 28.

In an embodiment coupler 2 is included entirely within the outer conduit.

In the embodiment of FIG. 7 the additional outer conduit includes additional proximal and distal ends. The additional proximal end includes additional outer threads 8' and the additional distal end includes additional inner threads 9'. The additional outer threads 8' directly couple to the inner threads 9. By allowing two guns to mate directly to each other (at a single junction) there is one less junction compared to previous technologies. For example, with a coupler or tandem sub there are two interfaces at the two spots where the tandem sub interfaces the two guns. These interfaces are an area where drilling fluids and the like can enter the gun and prevent charges from detonating. However, decreasing the number of interfaces for such leakage provides another advantage for embodiments described herein.

In an embodiment the outer conduit includes long axis 38 that intersects the proximal and distal caps. A plane, which is orthogonal to the long axis, intersects the additional outer threads, the inner threads, and the coupler.

In the embodiment of FIG. 1A inner threads 9 are keyed to coupler 2. For example, projection 25 is keyed to void 26 to ensure the coupler is oriented in only one way to the outer tube.

Figure 2B:
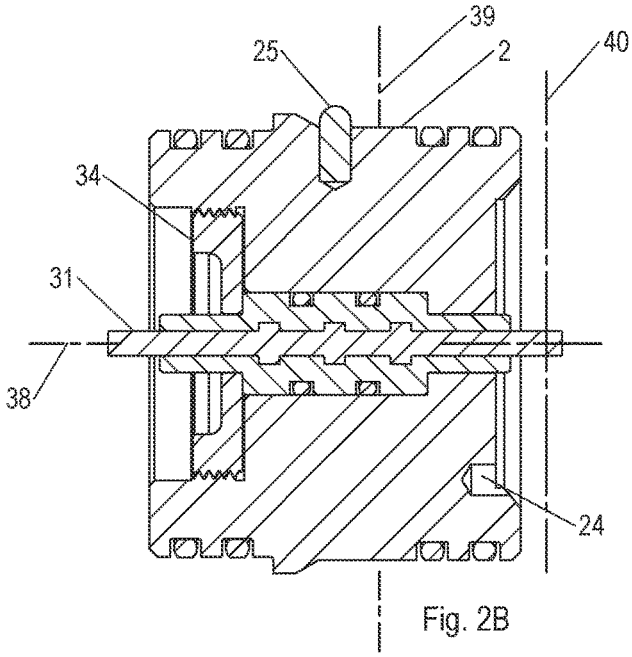
FIG. 2B includes a cross-sectional view of the same.
Figure 2C:
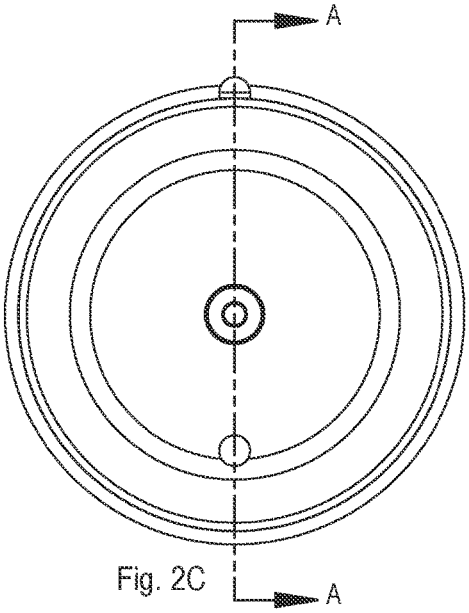
FIG. 2C provides a front view of the same.
Figure 2A:
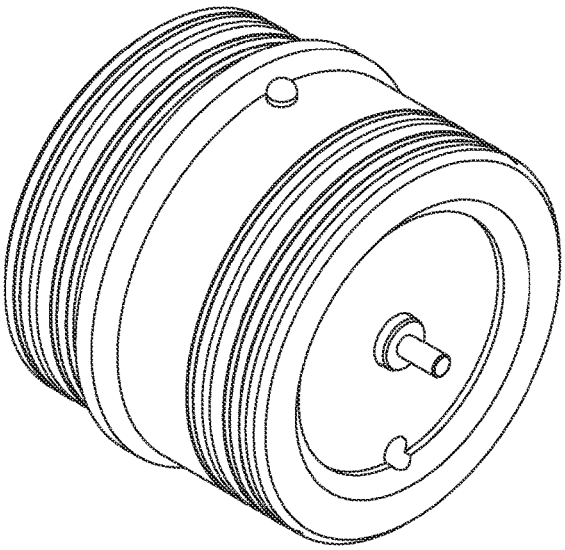
FIG. 2A includes a perspective view of an embodiment of a coupler (also known as a sub assembly) having a bulkhead.
Figure 3B:
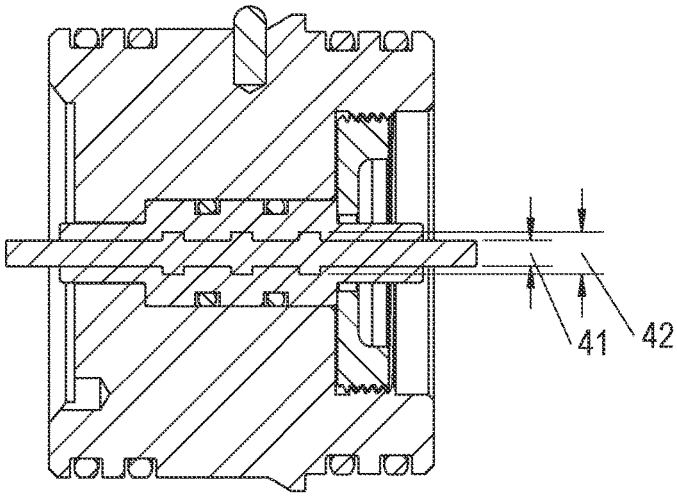
FIG. 3B includes a cross-sectional view of the same.
Figure 3C:
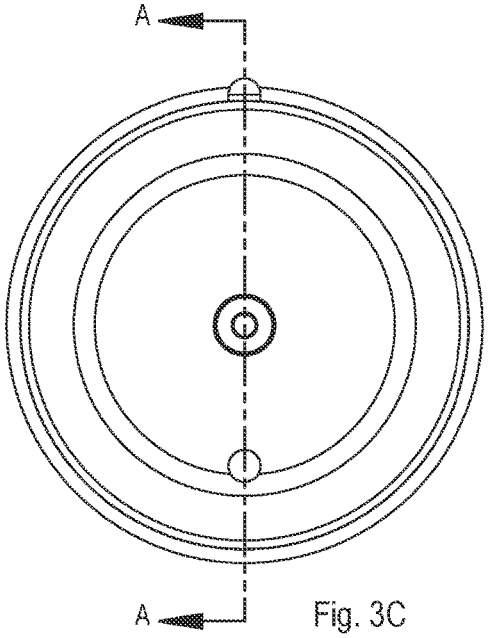
FIG. 3C provides a front view of the same.
Figure 3A:
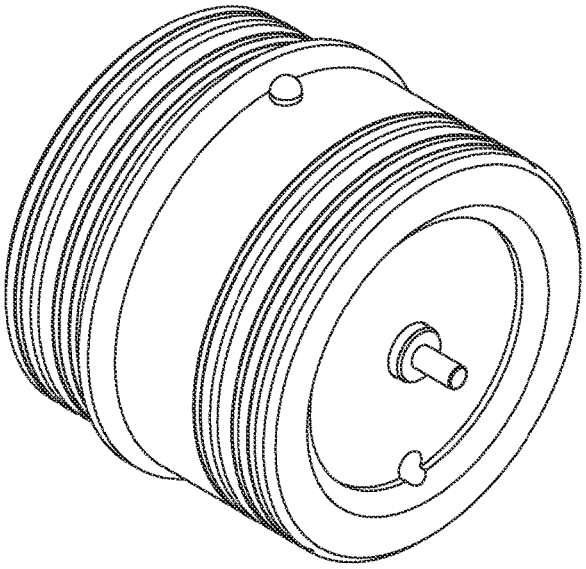
FIG. 3A includes a perspective view of an embodiment of a coupler (also known as a sub assembly) having a bulkhead.
Figure 4A:
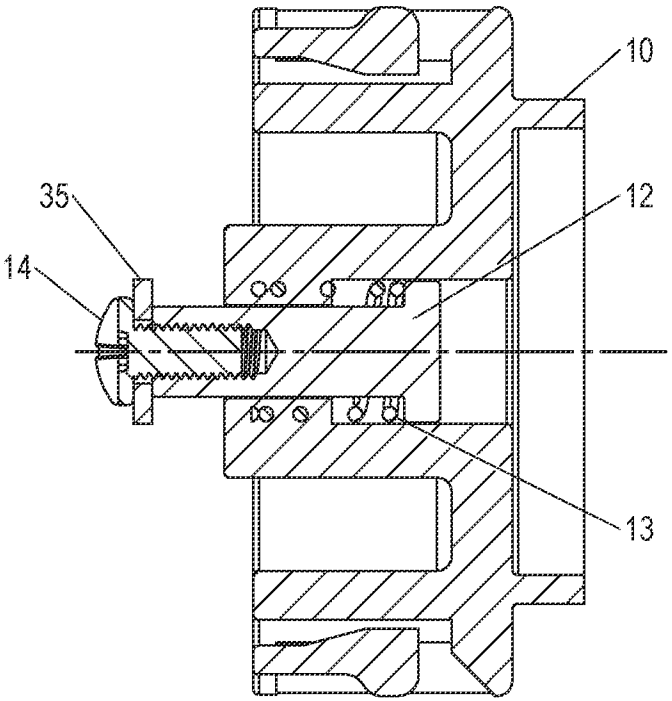
FIG. 4A includes a cross-sectional view of an embodiment of a distal cap (also referred to as a bottom cap).
Figure 5B:
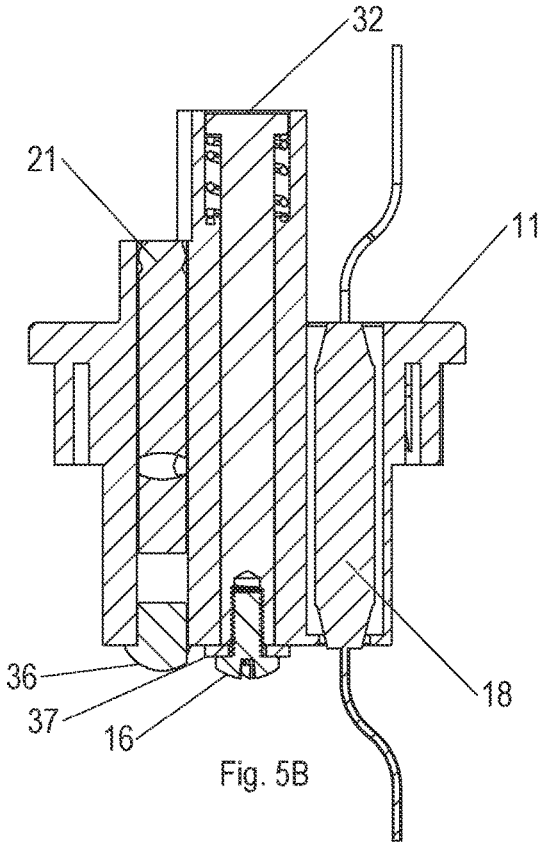
FIG. 5B includes a cross-sectional view of the same.
Figure 5C:
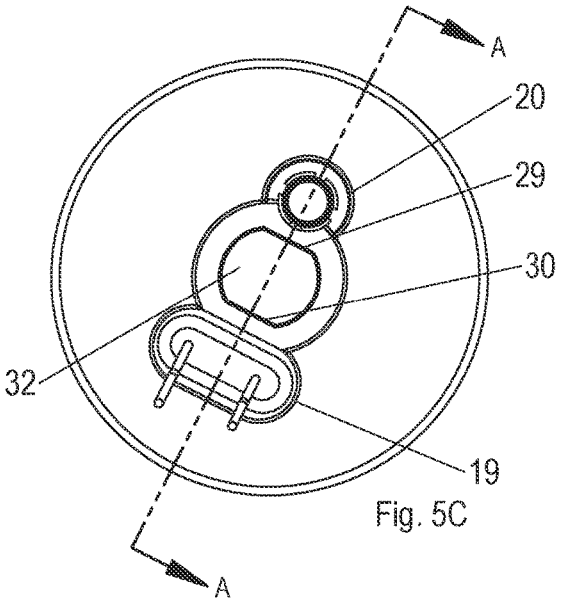
FIG. 5C includes a front view of the same.
Figure 5A:
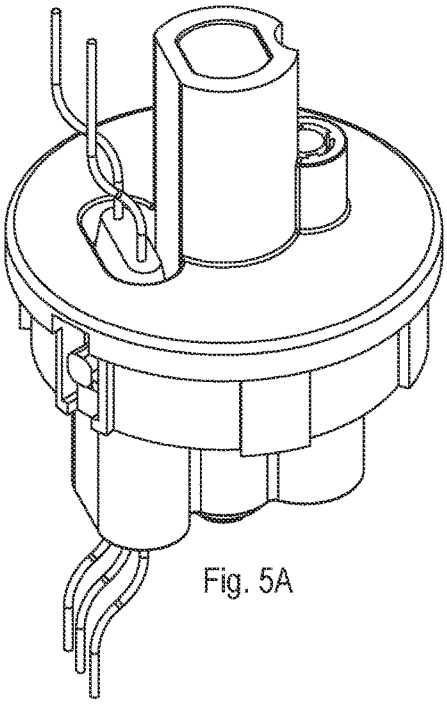
FIG. 5A includes a perspective view of an embodiment of a proximal cap (also referred to as a top cap).
Figure 6D:
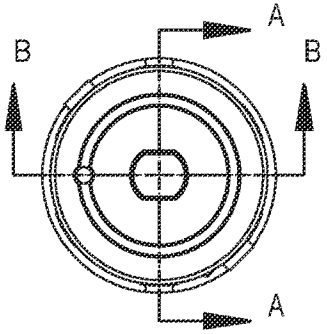
FIG. 6D provides a rear view of the same.
Figure 6A:
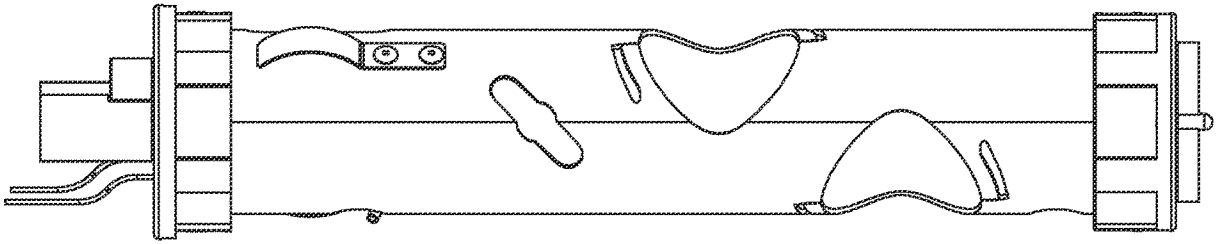
FIG. 6A includes a side view of an embodiment of an inner conduit.
Figure 6B:
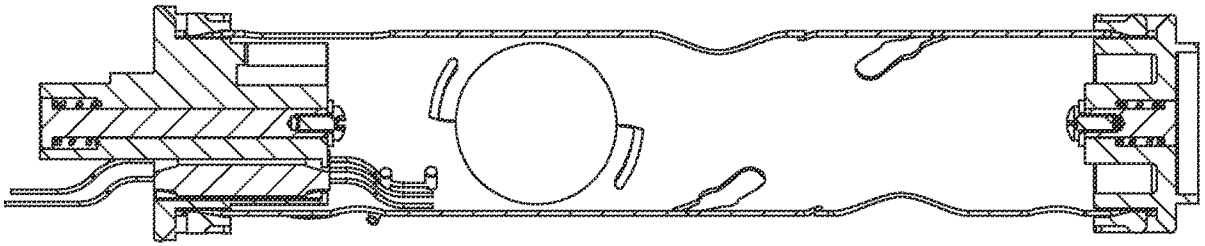
FIGS. 6B and 6C provide cross-sectional views of the same.
Figure 6C:
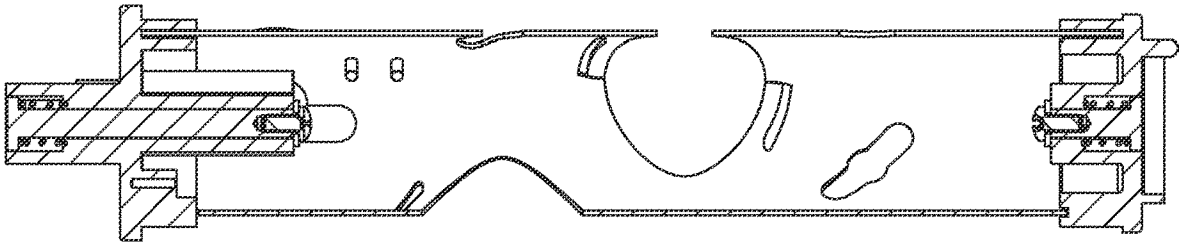

FIG. 1A also discloses top thread protector 5, retaining ring 4, bottom thread protector 6, and o-ring 7. FIG. 2B discloses a bulkhead retainer unit 34. FIG. 3B shows a modified version of contact 31 of FIG. 2B. FIG. 4A discloses washer 35. FIG. 5B discloses detonator plug 36 and washer 37.

Example 1: A hydraulic fracturing system comprising: a perforating gun, the perforating gun including an outer conduit (1), an inner conduit (3), a proximal cap (11), a distal cap (10), a coupler (2), a bulkhead (22); wherein the inner conduit is included within the outer conduit; wherein the outer conduit includes proximal and distal ends, the proximal end including outer threads (8) and the distal end including inner threads (9); wherein (a)(i) the distal cap includes a first distal electric contact (12) and a second distal electric contact (14), (a)(ii) the first distal electric contact is resiliently coupled to a body of the distal cap via a distal resilient member (13), (a)(iii) the second distal electric contact is resiliently coupled to the body of the distal cap via the distal resilient member, (a)(iv) the first distal electric contact includes at least one metal, the at least one metal including at least one of stainless steel, bronze, brass, tin-plated metal, or combinations thereof; wherein (b)(i) the proximal cap includes a first proximal electric contact (15) and a second proximal electric contact (16), (b)(ii) the first proximal electric contact is resiliently coupled to a body of the proximal cap via a second resilient member (17), (b)(iii) the second proximal electric contact is resiliently coupled to the body of the proximal cap via the second resilient member, (b)(iv) the first proximal electric contact includes at least one metal, the at least one metal including at least one of stainless steel, bronze, brass, tin-plated metal, or combinations thereof; (b)(v) the proximal cap includes an aperture (19) and the aperture includes an electrical switch (18), (b)(vi) the electrical switch couples at least one cable that is proximal to the proximal cap to at least one cable that is distal to the proximal cap; (b)(vii) the proximal cap includes an additional aperture (20) and the additional aperture includes a detonator (21); an additional perforating gun, the additional perforating gun including an additional outer conduit, an additional inner conduit, an additional proximal cap, an additional distal cap, the additional proximal cap including (c)(i) an additional first proximal electric contact and an additional second proximal electric contact (16), (c)(ii) the additional first proximal electric contact is resiliently coupled to a body of the additional proximal cap via an additional second resilient member, (c)(iii) the additional second proximal electric contact is resiliently coupled to the body of the additional proximal cap via the additional second resilient member, (c)(iv) the additional first proximal electric contact includes at least one metal, the at least one metal including at least one of stainless steel, bronze, brass, tin-plated metal, or combinations thereof; wherein (d)(i) the coupler has no external threads, (d)(ii) the bulkhead is included within the coupler, (d)(iii) bulkhead includes no resilient members, (d)(iv) the bulkhead directly contacts both the first distal electrical contact and the additional first proximal electrical contact, (d)(v) the first resilient member biases the first distal electrical contact towards the bulkhead in a first direction and the additional second resilient member biases the additional first proximal electrical contact towards the bulkhead in a second direction that is opposite the first direction.

Example 2. The system of example 1 wherein the inner threads are keyed to the coupler.

Example 3. The system of example 2 wherein the coupler is keyed to the distal cap.

Example 4. The system of example 1, wherein the coupler is included entirely within the outer conduit.

Example 5. The system of example 4, wherein: the additional outer conduit includes additional proximal and distal ends, the additional proximal end including additional outer threads and the additional distal end including additional inner threads; the additional outer threads directly couple to the inner threads.

Example 5.1. The system of example 5, wherein: the outer conduit includes a long axis that intersects the proximal and distal caps; a plane, which is orthogonal to the long axis, intersects the additional outer threads, the inner threads, and the coupler.

Example 6. The system of example 4, wherein: the additional outer conduit includes additional proximal and distal ends, the additional proximal end including additional outer threads and the additional distal end including additional inner threads; the additional inner threads directly couple to the outer threads.

Example 6.1. The system of example 6, wherein: the outer conduit includes a long axis that intersects the proximal and distal caps; a plane, which is orthogonal to the long axis, intersects the outer threads, the additional inner threads, and the coupler.

Example 7. The system of example 4 wherein the outer conduit directly contacts the additional outer conduit.

Example 8. The system of example 7, wherein: the outer conduit includes a long axis that intersects the proximal and distal caps; a plane, which is orthogonal to the long axis, intersects the outer conduit, the additional outer conduit, and the coupler.

Example 9. The system of example 7, wherein: the outer conduit includes a long axis that intersects the proximal and distal caps; a plane, which is orthogonal to the long axis, intersects the outer conduit, the additional outer conduit, and the additional first proximal electric contact.

Example 10. A hydraulic perforating gun system comprising: an outer conduit (1); an inner conduit (3); a proximal cap (11); a distal cap (10); a coupler (2); a bulkhead (22); wherein the inner conduit is proportioned to be included within the outer conduit; wherein the outer conduit includes proximal and distal ends, the proximal end including outer threads (8) and the distal end including inner threads (9); wherein (a)(i) the distal cap includes a first distal electric contact (12) and a second distal electric contact (14), (a)(ii) the first distal electric contact is resiliently coupled to a body of the distal cap via a distal resilient member (13), (a)(iii) the second distal electric contact is resiliently coupled to the body of the distal cap via the distal resilient member, (a)(iv) the first distal electric contact includes at least one metal; wherein (b)(i) the proximal cap includes a first proximal electric contact (15) and a second proximal electric contact (16), (b)(ii) the first proximal electric contact is resiliently coupled to a body of the proximal cap via a second resilient member (17), (b)(iii) the second proximal electric contact is resiliently coupled to the body of the proximal cap via the second resilient member, (b)(iv) the first proximal electric contact includes at least one metal; (b)(v) the proximal cap includes an aperture (19) and the aperture includes an electrical switch (18), (b)(vi) the electrical switch couples at least one cable that is proximal to the proximal cap to at least one cable that is distal to the proximal cap; (b)(vii) the proximal cap includes an additional aperture (20) and the additional aperture includes a detonator (21); wherein (c)(i) the coupler has no external threads, (c)(ii) the bulkhead is included within the coupler, (c)(iii) the bulkhead includes no resilient members, (d)(iv) the bulkhead is configured to directly contact the first distal electrical contact and another contact of another gun, (d)(v) the first resilient member is configured to bias the first distal electrical contact towards the bulkhead.

Example 11. A hydraulic perforating gun system comprising: an outer conduit (1); an inner conduit (3); a proximal cap (11); a distal cap (10); a coupler (2); a bulkhead (22); wherein the inner conduit is proportioned to be included within the outer conduit; wherein the outer conduit includes proximal and distal ends, the proximal end including outer threads (8) and the distal end including inner threads (9); wherein (a)(i) the distal cap includes a first distal electric contact (12) and a second distal electric contact (14), (a)(ii) the first distal electric contact is resiliently coupled to a body of the distal cap via a distal resilient member (13), (a)(iii) the second distal electric contact is resiliently coupled to the body of the distal cap via the distal resilient member, (a)(iv) the first distal electric contact includes at least one metal; wherein (b)(i) the proximal cap includes a first proximal electric contact (15) and a second proximal electric contact (16), (b)(ii) the first proximal electric contact is resiliently coupled to a body of the proximal cap via a second resilient member (17), (b)(iii) the second proximal electric contact is resiliently coupled to the body of the proximal cap via the second resilient member, (b)(iv) the first proximal electric contact includes at least one metal; wherein (c)(i) the coupler has no external threads, (c)(ii) the bulkhead is included within the coupler, (c)(iii) the bulkhead includes no resilient members, (d)(iv) the bulkhead is configured to directly contact the first distal electrical contact and another contact of another gun, (d)(v) the first resilient member is configured to bias the first distal electrical contact towards the bulkhead.

Example 12. An apparatus comprising: proximal and distal caps; a conduit configured to couple to the distal and proximal caps; wherein (a)(i) the distal cap includes a first distal electric contact (12) and a second distal electric contact (14), (a)(ii) the first distal electric contact is resiliently coupled to a body of the distal cap via a distal resilient member (13), (a)(iii) the second distal electric contact is resiliently coupled to the body of the distal cap via the distal resilient member, (a)(iv) the first distal electric contact includes at least one metal; wherein (b)(i) the proximal cap includes a first proximal electric contact (15) and a second proximal electric contact (16), (b)(ii) the first proximal electric contact is resiliently coupled to a body of the proximal cap via a second resilient member (17), (b)(iii) the second proximal electric contact is resiliently coupled to the body of the proximal cap via the second resilient member, (b)(iv) the first proximal electric contact includes at least one metal.

Example 13. A coupler comprising: a bulkhead; a plurality of O-rings; wherein (a)(i) the coupler has no external threads, (a)(ii) the bulkhead is included within the coupler, (a)(iii) the bulkhead includes no resilient members.

Example 14. A hydraulic perforating gun system comprising: an outer conduit (1); an inner conduit (3); a proximal cap (11); a distal cap (10); a coupler (2); wherein the inner conduit is proportioned to be included within the outer conduit; wherein the outer conduit includes proximal and distal ends, the proximal end including outer threads (8) and the distal end including inner threads (9); wherein (a)(i) the distal cap includes a first distal electric contact (12) and a second distal electric contact (14), (a)(ii) the first distal electric contact is resiliently coupled to a body of the distal cap via a distal resilient member (13), (a)(iii) the second distal electric contact is resiliently coupled to the body of the distal cap via the distal resilient member, (a)(iv) the first distal electric contact includes at least one metal; wherein (b)(i) the proximal cap includes a first proximal electric contact (15) and a second proximal electric contact (16), (b)(ii) the first proximal electric contact is resiliently coupled to a body of the proximal cap via a second resilient member (17), (b)(iii) the second proximal electric contact is resiliently coupled to the body of the proximal cap via the second resilient member, (b)(iv) the first proximal electric contact includes at least one metal; wherein (c)(i) the coupler has no external threads, (c)(ii) an additional electrical contact is included within the coupler, (c)(iii) the additional electrical contact has no spring-induced physical bias, (d)(iv) the additional electrical contact is configured to directly contact the first distal electrical contact and another contact of another gun, (d)(v) the first resilient member is configured to bias the first distal electrical contact towards the additional contact.

Example 1A. A hydraulic fracturing system comprising: a perforating gun that includes an outer conduit, an inner conduit included in the outer conduit, proximal and distal connectors, a coupler, and a bulkhead included in the coupler; wherein (a)(i) the distal connector includes a distal electric contact resiliently coupled to a body of the distal connector via a distal resilient member, and (a)(ii) the proximal connector includes a proximal electric contact resiliently coupled to a body of the proximal connector via a proximal resilient member; wherein (b)(i) the proximal connector includes a first aperture that includes an electrical switch that couples at least one cable that is proximal to the proximal connector to at least one cable that is distal to the proximal connector; and (b)(ii) the proximal connector includes a second aperture to receive a detonator; wherein (c)(i) the coupler is unthreaded, (c)(ii) the bulkhead includes a bulkhead electric contact and the bulkhead includes no resilient members, (c)(iv) the bulkhead electric contact directly contacts the distal electrical contact and is configured to directly contact an additional proximal electrical contact of an additional perforating gun's additional proximal connector, (d)(v) the distal resilient member biases the distal electrical contact towards the bulkhead in a first direction and the proximal resilient member biases the proximal electrical contact in a second direction that is opposite the first direction.

In an embodiment, the distal or proximal connectors may include caps that cap off opposing ends of the inner conduit. Such connectors may include plugs or other means to plug or close, fully or partially, opposing ends of the inner conduit. Such connectors may provide means for energy (e.g., an electrical signal, a percussive surge) to traverse the gun across the inner tube.

As used herein, an aperture includes an opening, hole, or gap. In an embodiment, portions of the first and second apertures connect to one another.

Another version of Example 1A. A hydraulic fracturing system comprising: a perforating gun that includes an outer conduit, an inner conduit included in the outer conduit, proximal and distal connectors, a coupler, and a bulkhead included in the coupler; wherein (a)(i) the distal connector includes a distal electric contact resiliently coupled to a body of the distal connector via a distal resilient member, and (a)(ii) the proximal connector includes a proximal electric contact resiliently coupled to a body of the proximal connector via a proximal resilient member; wherein (b)(i) the proximal connector includes a first aperture that includes an electrical switch that couples at least one cable that is proximal to the proximal connector to at least one cable that is distal to the proximal connector; and (b)(ii) the proximal connector includes a second aperture to receive a detonator;

wherein (c)(i) the coupler is unthreaded, (c)(ii) the bulkhead includes a bulkhead electric contact and the bulkhead electric contact includes no resilient members, (c)(iii) the bulkhead electric contact directly contacts the distal electrical contact and is configured to directly contact an additional proximal electrical contact of an additional perforating gun's additional proximal connector, (c)(iv) the distal resilient member biases the distal electrical contact towards the bulkhead in a first direction and the proximal resilient member biases the proximal electrical contact in a second direction that is opposite the first direction.

Example 2A. The system of example 1A, wherein the bulkhead electric contact is monolithic and includes no welds, seems, or resilient members.

As used herein, monolithic means formed of a single piece of material. For example, the bulkhead electric contact may be formed via machining or removing material from a single piece of metal via a lathe process or the like.

Example 3A. The system of example 2 A, wherein: the outer conduit includes a long axis that intersects the proximal and distal connectors; a first plane, which is orthogonal to the long axis, intersects the bulkhead and the bulkhead electric contact; and a second plane, which is orthogonal to the long axis, intersects the bulkhead electric contact but not the bulkhead.

For example, see axes 38, 39, 40.

Example 4A. The system of example 2A, wherein: the bulkhead includes a gasket; the gasket directly contacts the bulkhead electric contact; the outer conduit includes a long axis that intersects the proximal and distal connectors; and a first plane, which is orthogonal to the long axis, intersects the bulkhead electric contact and the gasket.

Figure 15B:
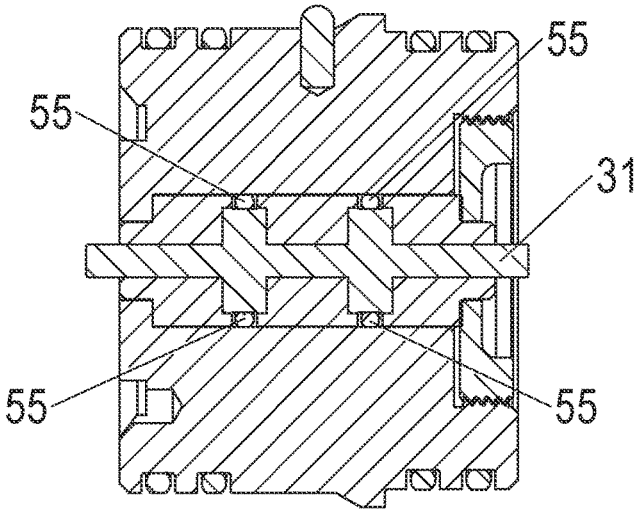
FIGS. 15A, 15B, and 15C provide perspective, cross-sectional, and front views of an embodiment of a bulkhead.
Figure 15C:
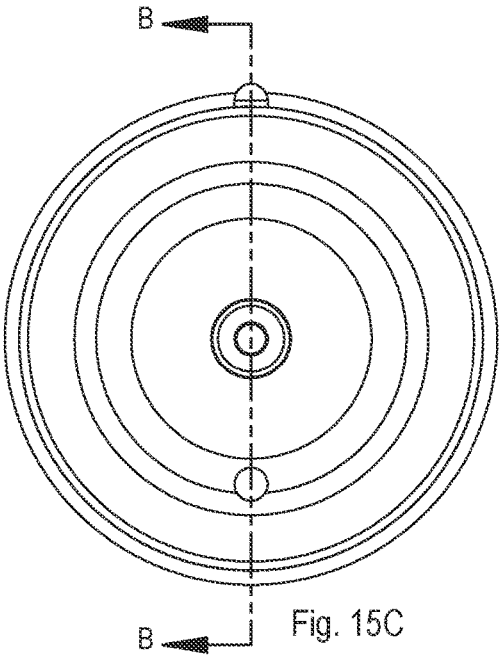
Figure 15A:
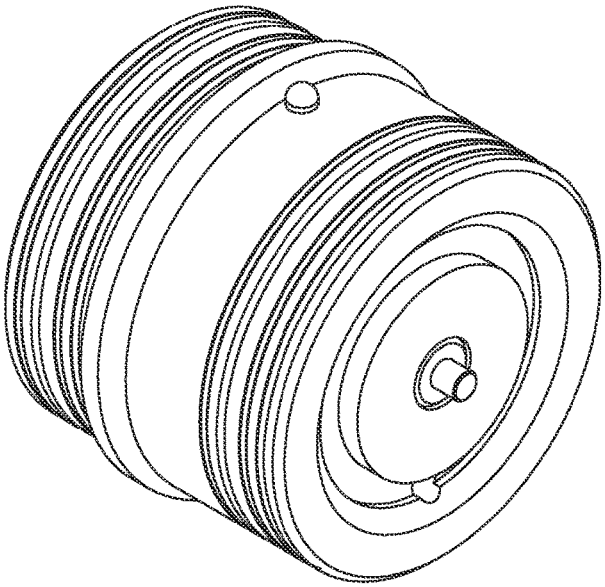

For example, an o-ring is a type of gasket. For instance, see FIG. 15B.

Example 5A. The system of example 2A, wherein: the outer conduit includes a first long axis that intersects the proximal and distal connectors; and the bulkhead electric contact includes a second long axis that is collinear with the first long axis.

For example, see FIG. 2B.

Example 6A. The system of example 5A, wherein: the bulkhead electric contact includes first and second portions; the first portion includes a first width that is oriented orthogonal to the second long axis; the second portion include a second width that is oriented orthogonal to the second long axis; the first width is unequal to the second width; a first plane, which is orthogonal to the second long axis, intersects the bulkhead and first portion; and a second plane, which is orthogonal to the second long axis, intersects the bulkhead and the second portion.

For example, see widths 41, 42 of FIG. 3B.

Example 7A. The system of example 6A, comprising an overmold, wherein: the overmold includes a non-metal material; the bulkhead includes the overmold; and the overmold directly contacts the first and second portions of the bulkhead electric contact.

Another version of Example 7A. The system of example 6A, comprising a mold, wherein: the mold includes a non-metal material; the bulkhead electric contact includes metal; the bulkhead includes the mold; and the mold directly contacts and is form-fitted to the first and second portions of the bulkhead electric contact.

As used herein, over molding includes the use of layering effects in polymer application techniques. This process is centered around the use of a liquidous resin to add additional layers of shape and structure to an existing component. An example of such a resin could be a polymer that has been heated to a temperature just above its glass transition temperature. The existing component to which the resin is being added is often injection molded as well (but that is not necessarily the case for embodiments used herein), and may be near its own glass transition temperature.

Another embodiment may utilize insert molding, which is a similar process to overmolding but instead uses a preformed part, often metal, that is loaded into a mold where it is then overmolded with a thermoplastic resin to create a final component. When the run is complete, parts are boxed and shipped shortly thereafter.

Regardless of overmolding or insert molding, embodiments include a material that is molded to the bulkhead electric contact.

Figure 12C:
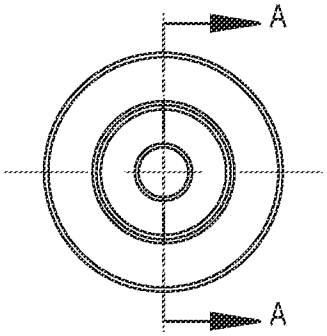
FIG. 12A includes a perspective view of an embodiment of a bulkhead electric contact or conductor.
FIG. 12B provides a cross-sectional view of the contact and FIG. 12C provides a front view of the contact.
Figure 12B:
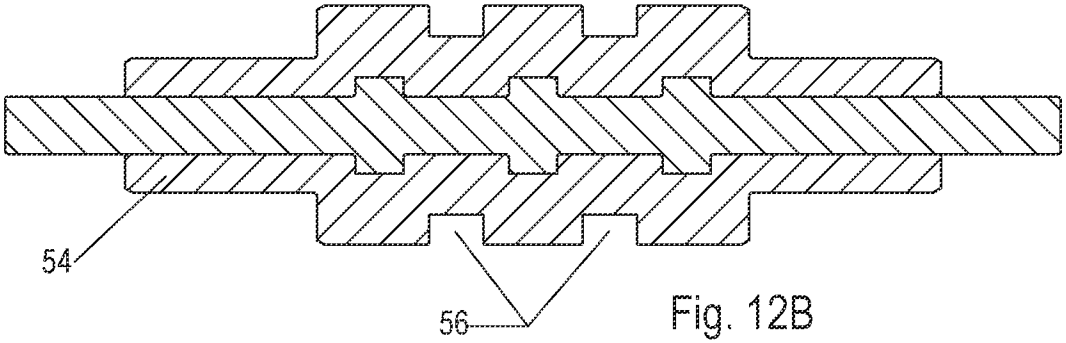
Figure 12A:
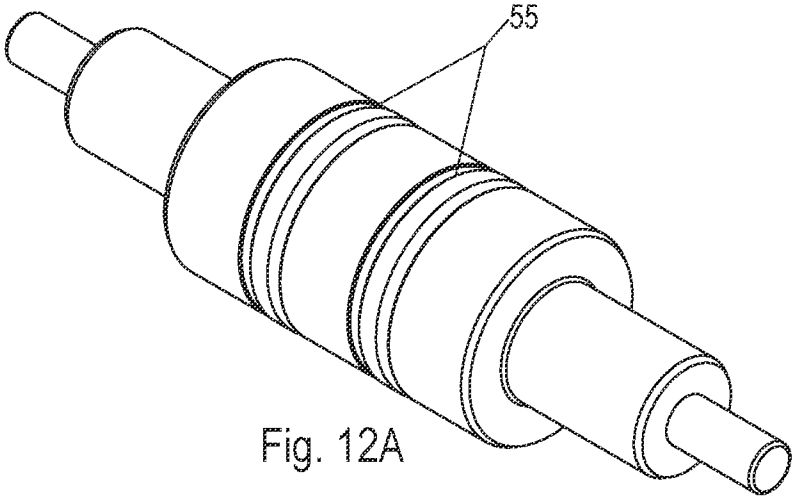
Figure 13B:
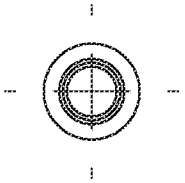
FIG. 13B provides a front view of the contact.
Figure 13A:
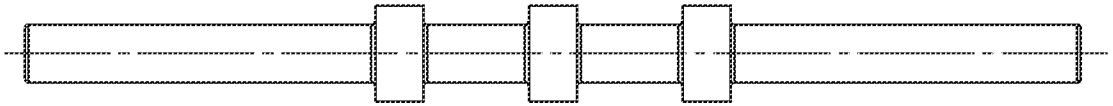
FIG. 13A includes a side view of an embodiment of a bulkhead electric contact (also referred to as a bulkhead conductor).
Figure 14C:
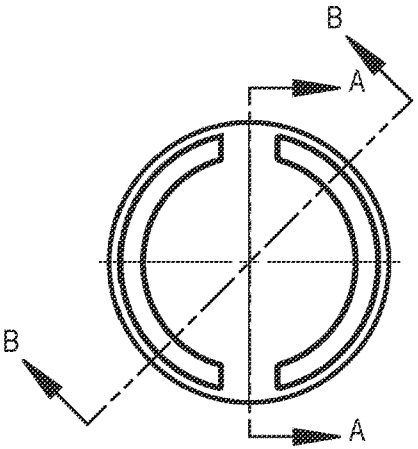
FIG. 14C provides a rear or bottom view of the same.
Figure 14A:
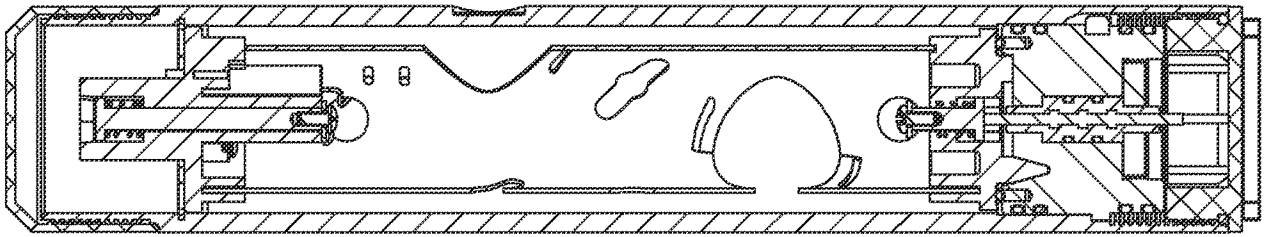
FIGS. 14A and 14B provide cross-sectional views of an embodiment of a perforation gun system.
Figure 14B:
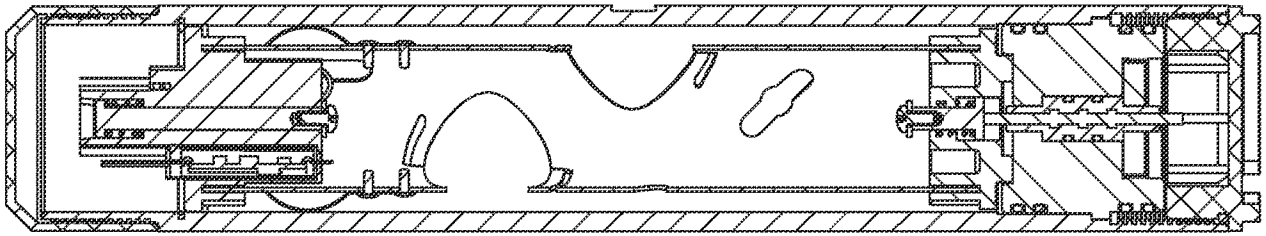

FIG. 12B provides a view of overmold 54. In an embodiment, overmold 54 includes polyether ether ketone (PEEK). Gaskets (e.g., o-rings) 55 reside within voids 56 formed, at least partially, in the overmold.

Example 8A. The system of example 1A, wherein: the outer conduit includes internal threads; the coupler includes a projection; and the internal threads are keyed to the coupler's projection.

This keying may help ensure the inner conduit's charges properly align with the outer conduit's voids. Thus, voids 27, 28 align with each other.

Example 9A. The system of example 8A, wherein the coupler is keyed to the distal connector.

Example 10A. The system of example 1A, wherein: the outer conduit includes a long axis that intersects the proximal and distal connectors; a first plane, which is orthogonal to the long axis, intersects the distal electric contact; the distal electric contact includes a non-circular cross-section within the first plane; a second plane, which is orthogonal to the long axis, intersects the proximal electric contact; the proximal electric contact includes a non-circular cross-section within the second plane.

Such an orientation is advantageous because, for example, tightening a screw or fastener such as contact 32 or 33 occurs more easily if contact 15 or 13 resists turning with the tightening of a screwdriver. This helps reduce forces applied to cabling coupled to the contacts.

Example 11A. The system of example 1A, wherein: the distal connector has a proximal face and a distal face, and the proximal face is between the distal face and the proximal connector; the distal face includes first, second, and third projections; a proximal face of the coupler includes first, second, and third recesses, the first projection is keyed to the first recess and the second and third projections are respectively keyed to the second and third recesses; the outer conduit includes a long axis that intersects the proximal and distal connectors; a plane, which is orthogonal to the long axis, intersects the first projection but neither of the second or third projections.

For example, in FIGS. 8, 9A, 9B, and 9C, distal face 46 of the distal connector includes first projection 43, first recess 44, and second recess 45. Proximal face 50 of coupler 2 includes a recess 47, first projection 48, and second projection 49. Projection 43 is keyed to the recess 47. Projections 48, 49 are respectively keyed to recesses 44, 45.

Another version of Example 11A. The system of example 1A, wherein: the distal connector has a proximal face and a distal face, and the proximal face is between the distal face and the proximal connector; the distal face of the distal connector includes a first projection and a first recess; a proximal face of the coupler includes a second recess and a second projection; the first projection is keyed to the first recess and the second projection is keyed to the second recess; the outer conduit includes a long axis that intersects the proximal and distal connectors; a plane, which is orthogonal to the long axis, intersects the first projection but not the first recess.

Another version of Example 11A. The system of example 1A, wherein: the distal connector has a proximal face and a distal face, and the proximal face is between the distal face and the proximal connector; the distal face of the distal connector includes a projection and one of a first recess and a first projection; a proximal face of the coupler includes another of the first recess and the first projection; the first projection is keyed to the first recess; the outer conduit includes a long axis that intersects the proximal and distal connectors; a plane, which is orthogonal to the long axis, intersects the first projection but not the one of a first recess and a first projection.

Example 12A. The system of example 11A, wherein none of the first, second, or third projections includes metal.

Another version of Example 12A. The system of example 11A, wherein neither of the first projection or the first recess includes metal.

This is advantageous in that a user desiring a fixed orientation of the inner conduit 3 with regard to the outer conduit 1 may couple projection 43 with recess 47. However, a user desiring a variable orientation between the tubes may remove projection 43. For example, projection 43 may be formed from a polymer and projection 43 may be cut or otherwise removed from face 46. As a result, the user is then able to rotate face 46 to align the proper recess (one of recesses 44, 45) with one of projections 48, 49. Projections 48, 49 may be biased away from face 46 and towards face 50. Projections may include spring loaded ball plungers.

Example 13A. The system of example 11A, wherein the second projection couples to a resilient member that biases the projection away from the proximal face of the coupler and towards the distal connector.

For instance, the resilient member may be included in a spring-loaded ball plunger.

Figure 11D:
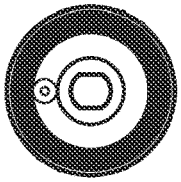
FIG. 11D provides a view of a distal connector.
Figure 11A:
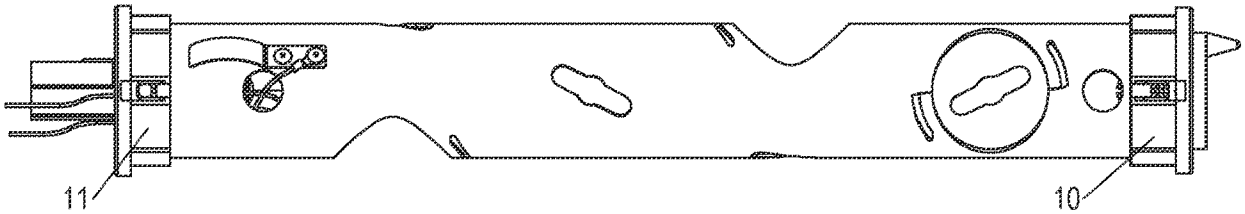
FIGS. 11A and 11B provide side views of an embodiment of an inner tube.
Figure 11B:
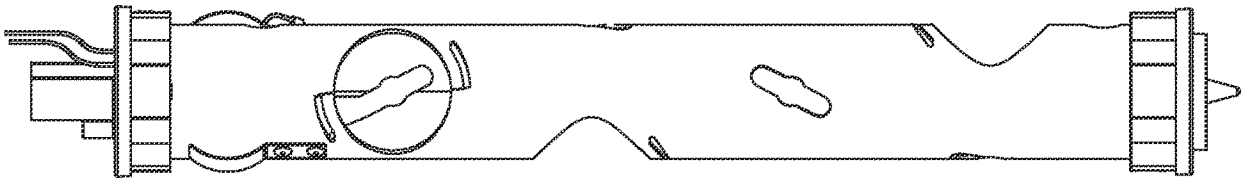
Figure 11C:
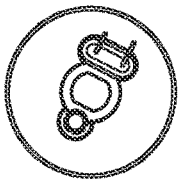
FIG. 11C provides a front view of a proximal connector.

FIGS. 10A and 10B provide perspective and assembly views for an embodiment a proximal connector. FIG. 11C shows an embodiment of a proximal connector 11.

Example 14A. A system comprising: (a)(i) a first perforating gun including first proximal and distal connectors on opposing ends of a first inner conduit; and (a)(ii) a second perforating gun including second proximal and distal connectors on opposing ends of a second inner conduit; and a coupler that includes a bulkhead; wherein (b)(i) the first distal connector is resiliently coupled to a first distal electric contact via a first distal resilient member, and (b)(ii) the second proximal connector is resiliently coupled to a second proximal electric contact via a second resilient member; wherein (c)(i) the bulkhead includes a bulkhead electric contact that includes no resilient members, (c)(ii) the bulkhead electric contact directly contacts the first distal electrical contact and the second proximal electrical contact, (c)(iii) the first distal resilient member biases the first distal electrical contact towards the bulkhead in a first direction and the second proximal resilient member biases the second proximal electrical contact towards the bulkhead in a second direction that is opposite the first direction.

Figure 1B:
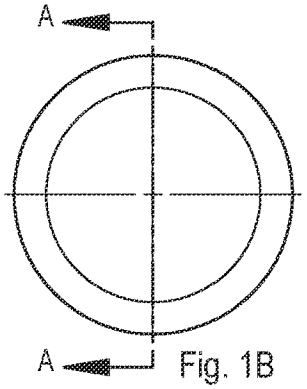
FIG. 1B includes a front view of the same.

Embodiments provide multiple options that promote ease of indexing to more easily align shots. For example, FIGS. 1 (indexed distal connector and coupler), 2A, and 8 (element 43) provide one form of indexing (a single index position) while removing element 43 allows FIG. 8 to have many different index positions. Thus, the user may decide what is best for a particular situation and then quickly and easily adjust the gun system to meet the need. Another advantage concerns the non-circular contacts of FIGS. 5B and 5C, which help a user tighten a contact (e.g., screws 32, 33) without applying force to cabling connected to the contact. Yet another advantage includes the ability to view the detonation cord/proximal connector interface after the inner tube is fully seated within the outer tube. Other advantages concern, for example, the contact of FIG. 15B. If an explosion causes a gap to form between the bulkhead material (e.g., PEEK) and the metal contact, a gasket contacting the contact will prevent or lessen fluid flow between neighboring guns (which can improve reliability of neighboring guns). Another advantage concerns the use of a monolithic single-piece bulkhead electric contact. Such a contact may be machined from a single piece of metal. This reduces costs and increases reliability for the entire bulkhead. Further, such a contact may include machined voids (e.g., element 56), which foster better coupling between the molding and contact of the bulkhead.

The foregoing description of the embodiments of the invention has been presented for the purposes of illustration and description. It is not intended to be exhaustive or to limit the invention to the precise forms disclosed. This description and the claims following include terms, such as left, right, top, bottom, over, under, upper, lower, first, second, etc. that are used for descriptive purposes only and are not to be construed as limiting. For example, terms designating relative vertical position refer to a situation where a side of a substrate is the "top" surface of that substrate; the substrate may actually be in any orientation so that a "top" side of a substrate may be lower than the "bottom" side in a standard terrestrial frame of reference and still fall within the meaning of the term "top." The term "on" as used herein (including in the claims) does not indicate that a first layer "on" a second layer is directly on and in immediate contact with the second layer unless such is specifically stated; there may be a third layer or other structure between the first layer and the second layer on the first layer. The embodiments of a device or article described herein can be manufactured, used, or shipped in a number of positions and orientations. Persons skilled in the relevant art can appreciate that many modifications and variations are possible in light of the above teaching. Persons skilled in the art will recognize various equivalent combinations and substitutions for various components shown in the Figures. It is therefore intended that the scope of the invention be limited not by this detailed description, but rather by the claims appended hereto.

What is claimed is:

1. A hydraulic fracturing system comprising:

a perforating gun that includes an outer conduit, an inner conduit included in the outer conduit, proximal and distal connectors, a coupler, and a bulkhead included in the coupler;

wherein (a)(i) the distal connector includes a distal electric contact resiliently coupled to a body of the distal connector via a distal resilient member, and (a)(ii) the proximal connector includes a proximal electric contact resiliently coupled to a body of the proximal connector via a proximal resilient member;

wherein (b)(i) the proximal connector includes a first aperture that includes an electrical switch that couples at least one cable that is proximal to the proximal connector to at least one cable that is distal to the proximal connector; and (b)(ii) the proximal connector includes a second aperture to receive a detonator;

wherein (c)(i) the coupler is unthreaded, (c)(ii) the bulkhead includes a bulkhead electric contact and the bulkhead electric contact includes no resilient members, (c)(iii) the bulkhead electric contact directly contacts the distal electrical contact and is configured to directly contact an additional proximal electrical contact of an additional perforating gun's additional proximal connector, (c)(iv) the distal resilient member biases the distal electrical contact towards the bulkhead in a first direction and the proximal resilient member biases the proximal electrical contact in a second direction that is opposite the first direction.

2. The system of claim 1, wherein the bulkhead electric contact is monolithic and includes no welds, seems, or resilient members.

3. The system of claim 2, wherein:

the outer conduit includes a long axis that intersects the proximal and distal connectors;

a first plane, which is orthogonal to the long axis, intersects the bulkhead and the bulkhead electric contact; and a second plane, which is orthogonal to the long axis, intersects the bulkhead electric contact but not the bulkhead.

4. The system of claim 2, wherein:

the bulkhead includes a gasket;

the gasket directly contacts the bulkhead electric contact;

the outer conduit includes a long axis that intersects the proximal and distal connectors; and a plane, which is orthogonal to the long axis, intersects the bulkhead electric contact and the gasket.

5. The system of claim 2, wherein:

the outer conduit includes a first long axis that intersects the proximal and distal connectors; and the bulkhead electric contact includes a second long axis that is collinear with the first long axis.

6. The system of claim 5, wherein:

the bulkhead electric contact includes first and second portions;

the first portion includes a first width that is oriented orthogonal to the second long axis;

the second portion include a second width that is oriented orthogonal to the second long axis;

the first width is unequal to the second width;

a first plane, which is orthogonal to the second long axis, intersects the bulkhead and the first portion; and a second plane, which is orthogonal to the second long axis, intersects the bulkhead and the second portion.

7. The system of claim 6, comprising a mold, wherein:

the mold includes a non-metal material;

the bulkhead electric contact includes metal;

the bulkhead includes the mold; and the mold directly contacts and is form-fitted to the first and second portions of the bulkhead electric contact.

8. The system of claim 1, wherein:

the outer conduit includes internal threads;

the coupler includes a projection; and the internal threads are keyed to the coupler's projection.

9. The system of claim 8, wherein the coupler is keyed to the distal connector.

10. The system of claim 1, wherein:

the outer conduit includes a long axis that intersects the proximal and distal connectors;

a first plane, which is orthogonal to the long axis, intersects the distal electric contact;

the distal electric contact includes a non-circular cross-section within the first plane;

a second plane, which is orthogonal to the long axis, intersects the proximal electric contact;

the proximal electric contact includes a non-circular cross-section within the second plane.

11. The system of claim 1, wherein:

the distal connector has a proximal face and a distal face, and the proximal face is between the distal face and the proximal connector;

the distal face of the distal connector includes a first projection and a first recess;

a proximal face of the coupler includes a second recess and a second projection;

the first projection is keyed to the second recess and the second projection is keyed to the first recess;

the outer conduit includes a long axis that intersects the proximal and distal connectors;

a plane, which is orthogonal to the long axis, intersects the first projection but not the first recess.

12. The system of claim 11, wherein neither of the first projection or the first recess includes metal.

13. The system of claim 11, wherein the second projection couples to a resilient member that biases the projection away from the proximal face of the coupler and towards the distal connector.

14. The system of claim 1, wherein the coupler is configured to couple the perforating gun to the additional perforating gun and to reduce a transmission of explosive induced pressure between the perforating gun and the additional perforating gun.

15. A system comprising:

(a)(i) a first perforating gun including first proximal and distal connectors on opposing ends of a first inner conduit; and (a)(ii) a second perforating gun including second proximal and distal connectors on opposing ends of a second inner conduit; and a coupler that includes a bulkhead;

wherein (b)(i) the first distal connector is resiliently coupled to a first distal electric contact via a first distal resilient member, and (b)(ii) the second proximal connector is resiliently coupled to a second proximal electric contact via a second resilient member;

wherein (c)(i) the first proximal connector includes an aperture that includes an electrical switch, (c)(ii) the bulkhead includes a bulkhead electric contact that includes no resilient members, (c)(iii) the bulkhead electric contact directly contacts the first distal electrical contact and the second proximal electrical contact, (c)(iv) the first distal resilient member biases the first distal electrical contact towards the bulkhead in a first direction and the second proximal resilient member biases the second proximal electrical contact towards the bulkhead in a second direction that is opposite the first direction.

16. The system of claim 15, wherein the bulkhead electric contact is monolithic.

17. The system of claim 16, wherein:

the bulkhead electric contact includes first and second portions;

the first portion includes a first width oriented orthogonal a long axis of the gun;

the second portion include a second width that is unequal to the first width; and a first plane, orthogonal to the long axis, intersects the bulkhead and the first portion and a second plane, orthogonal to the long axis, intersects the bulkhead and the second portion.

18. The system of claim 17, wherein:

the bulkhead electric contact includes metal; and the bulkhead includes a non-metal mold that is form-fitted to the first and second portions of the bulkhead electric contact.

19. The system of claim 15, wherein:

a distal face of the first distal connector includes a projection and one of a first recess and a first projection;

a proximal face of the coupler includes another of the first recess and the first projection;

the first projection is keyed to the first recess;

the gun includes a long axis that intersects the first proximal and distal connectors;

a plane, orthogonal to the long axis, intersects the projection but not the one of the first recess and the first projection.

20. The system of claim 15, wherein the first proximal connector includes a detonator.

* * * * *